US005480567A

United States Patent [19]

Lam et al.

[11] Patent Number: 5,480,567

[45] Date of Patent: Jan. 2, 1996

[54] SURFACTANT MIXTURES FOR FABRIC CONDITIONING COMPOSITIONS

[75] Inventors: Andrew C. Lam, Yorktown, N.Y.; Samuel Q. Lin, Paramus, N.J.; Timothy J. Taylor, Edison, N.J.; John R. Winters, Dumont, N.J.

[73] Assignee: Lever Brothers Company, Division of Conopco, Inc., New York, N.Y.

[21] Appl. No.: 548,148

[22] Filed: XXX. 14, 1994

[51] Int. Cl.[6] ..... D06M 13/46; D06M 10/08; B05D 3/12

[52] U.S. Cl. ..... 252/8.8; 252/8.6; 252/8.7; 252/8.75; 427/242; 428/279

[58] Field of Search ..... 252/8.6, 8.7, 8.75, 252/8.8; 427/242; 428/279

[56] References Cited

U.S. PATENT DOCUMENTS

| | | | |
|---|---|---|---|
| 3,632,396 | 1/1972 | Perez-Zamora | 252/8.6 |
| 3,743,534 | 7/1973 | Perez Zamora | 427/11 |
| 3,944,694 | 3/1976 | McQueary | 427/242 |
| 3,947,971 | 4/1976 | Bauer | 427/242 |
| 3,989,631 | 11/1976 | Marsan | 252/8.6 |
| 4,007,300 | 2/1977 | McQueary | 427/242 |
| 4,012,540 | 3/1977 | McQueary | 427/242 |
| 4,049,858 | 9/1977 | murphy | 252/8.8 |
| 4,073,996 | 2/1978 | Bedenk et al. | 252/8.6 |
| 4,076,633 | 2/1978 | Edwards et al. | 252/8.75 |
| 4,128,484 | 12/1978 | Barford et al. | 252/8.6 |
| 4,137,180 | 1/1979 | Naik et al. | 252/8.8 |
| 4,170,678 | 10/1979 | Urfer et al. | 252/8.6 |
| 4,214,038 | 7/1980 | McCarty et al. | 252/8.6 |
| 4,238,531 | 12/1980 | Rudy et al. | 252/8.8 |
| 4,255,484 | 3/1981 | Stevens | 252/8.6 |
| 4,389,448 | 6/1983 | Green | 252/8.6 |
| 4,806,255 | 2/1989 | Konig et al. | 252/8.8 |
| 4,965,000 | 10/1990 | Potts et al. | 252/8.6 |
| 5,062,973 | 11/1991 | Kellett | 252/8.6 |
| 5,066,413 | 11/1991 | Kellett | 252/8.6 |
| 5,173,200 | 12/1992 | Kellett | 252/8.6 |
| 5,174,911 | 12/1992 | Lin et al. | 252/8.6 |
| 5,246,603 | 9/1993 | Tsaur et al. | 252/8.6 |
| 5,254,269 | 10/1993 | Taylor et al. | 252/8.6 |
| 5,300,238 | 4/1994 | Lin et al. | 252/8.6 |

*Primary Examiner*—Anthony Green
*Attorney, Agent, or Firm*—A. Kate Huffman

[57] ABSTRACT

A tumble dryer article comprising: a mixture of at least two surfactants, (i) a first surfactant present in an amount of about 5 wt. % to about 70 wt. % and having an endotherm peak temperature of from about 75° C. to about 155° C., (ii) a second surfactant present in an amount of about 30 wt. % to about 95 wt. % and having an endotherm peak temperature of from about 35° C. to about 70° C., wherein the peak temperatures of the first and second surfactant of the mixture are different from each other by at least about 1° C. as measured in a differential scanning calorimeter device and a melting transition temperature of the mixture being from about 50° C. to about 120° C.; and dispenser means for dispensing the mixture onto fabrics in a tumble dryer.

13 Claims, No Drawings

SURFACTANT MIXTURES FOR FABRIC CONDITIONING COMPOSITIONS

FIELD OF THE INVENTION

The present invention relates to a mixture of surfactants having at least two different endotherm peak temperatures for tumble dryer articles.

BACKGROUND OF THE INVENTION

Fabric conditioning actives applied to tumble dryer substrates generally transfer the actives onto fabrics once the actives melt inside the tumble dryer. This melting range in the dryer usually falls between 50° C. and 65° C. The melted active is then wicked from the tumble dryer substrate to the drying fabrics. It is known in the art to mix fabric conditioning actives with distributing agents to effectively transfer the actives from the substrate without staining the drying fabrics. See Rudy et al. U.S. Pat. No. 4,238,531; Marsan et al., U.S. Pat. No. 3,989,631; Edwards et al., U.S. Pat. No. 4,076,633. It is also known to mix a particular fabric conditioning active, e.g., sorbitan ester, with a fatty acid soap to modify the phase and viscosity behavior of the mixture to reduce fabric staining as described in U.S. Pat. No. 4,049,858.

These described mixtures, however, have only one melting point ranging from 38° C. to 100° C. Therefore, in melting point ranges above tumble dryer temperatures the actives do not melt effectively and are not transferred onto the fabrics.

High melting points are especially problematic in formulating desirable conditioning agents which exhibit excellent fabric care characteristics and which are environmentally friendly. See Naik et al., U.S. Pat. No. 4,137,180.

SUMMARY OF THE INVENTION

It is therefore an object of the invention to provide an article especially adapted for tumble dryers which comprises a mixture of surfactants having at least two endotherm peak temperatures which differ from each other and yet the mixture has a melting transition temperature of about 50° C. to about 120° C.

It is another object of the invention to provide a tumble dryer article which effectively transfers its fabric conditioning actives without staining the drying fabrics.

Another object of the invention is to provide an environmentally friendly mixture of surfactants which provides excellent fabric care.

The objects of the invention are achieved by combining about 5 wt. % to about 70 wt. % of a first surfactant having an endotherm peak temperature of from about 75° C. to about 155° C. and about 30 wt. % to about 95 wt. % of a second surfactant having an endotherm peak temperature from about 35° C. to about 70° C. to form a mixture. The resulting mixture has at least two endotherm peak temperatures which differ from each other by at least about 1° C. up to 40° C. and the mixture has a melting transition of temperature about 50° C. to about 120° C. The surfactant mixture is applied to a dispenser means, preferably a tumble dryer sheet.

Additional fabric conditioning actives and optional ingredients known in the art may also be added to the surfactant mixture.

DETAILED DESCRIPTION OF PREFERRED EMBODIMENTS

First Surfactant

The present invention relates to a mixture of surfactants applied to a tumble dryer article.

A first surfactant is present in the mixture in an amount of about 5 wt. % to about 70 wt. %, preferably 10 wt. % to about 40 wt. %, most preferably 20 wt. % to about 40 wt. %.

The first surfactant has an endotherm peak temperature of from about 75° C. to about 155° C., preferably 100° C. to about 150° C., most preferably 110° C. to about 150° C.

The endotherm peak temperature is measured by a differential scanning calorimeter device as known in the art. A particularly useful calorimeter is the DuPont 2100 device supplied by DuPont Corporation.

Suitable surfactants exhibiting this endotherm peak temperature include a water insoluble cationic fabric softening agent of formula

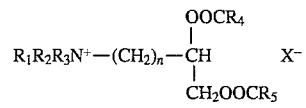

(I)

wherein $R_1$, $R_2$ and $R_3$ are independently selected from $C_{1-4}$ alkyl or hydroxyalkyl groups or $C_{2-4}$alkenyl groups; and wherein $R_4$ and $R_5$ are independently selected from $C_{7-27}$ alkyl or alkenyl groups; n is an integer from 0 to 5 and X represents a methyl sulfate; or a compound of formula

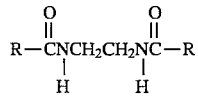

(II)

wherein R is a $C_{7-27}$alkyl or alkenyl group, preferably $C_{7-27}$alkyl.

A preferred compound of formula I is N,N-di(tallowoyloxy-ethyl)-N,N-dimethyl ammonium methyl sulfate (HEMS).

A particularly useful compound of formula II is ethylene bis-stearamide supplied by Witco Company of Illinois.

The peak endotherm temperature range of the compounds of formula I is about 115° C. to 125° C.

The peak endotherm temperature range of compounds of formula II is about 110° C. to 150° C.

Second Surfactant

The second surfactant to be combined with the first surfactant described above should have a lower endotherm peak temperature in the range of about 35° C. to about 70° C. This component should comprise about 30 wt. % to about 95 wt. %, preferably 60–75%.

Compounds which are preferred as the second surfactant include long chain fatty acids having at least one stearyl functional group and nonionic compounds selected from the group consisting of a linear $C_8$ to $C_{22}$ alcohol alkoxylated with 10 to 20 moles of alkylene oxide, long chain glycerol derivatives and sorbitan derivatives. Quaternized ammonium methyl salts used as fabric conditioners are also suitable as the second surfactant.

Examples of suitable long chain fatty acid materials include stearic acid having $C_{14-22}$ carbons and the eutectic mixture of stearic and palmitic acid material. A commercially available eutectic mixture is 45% stearic acid and 55% palmitic acid supplied as Emersol 132 supplied by Henkel.

Examples of suitable nonionic surfactants include methyl glucoside sesquistearate, methyl glucoside dioleate, sorbitan monostearate, sorbitan monooleate, glycerol monostearate, polyethylene glycol monostearate, and $C_{14}$–$C_{15}$ primary ethoxylated alcohol.

The mixture of the first and second surfactant must exhibit at least two peak endotherm temperatures differing from each by at least 1° C., preferably by about 10° C., most preferably by about 20° C. and up to about 40° C. difference. The mixture of the surfactants must exhibit a melting transition of from about 50° C. to about 120° C. as measured on a differential scanning calorimeter.

The endotherm peak temperature is the temperature at which maximum heat gain to the sample occurs.

Preferred combinations of the first and second surfactants include compounds of formula I with stearic acid, 45% stearic acid/55% palmitic acid, glycerol monostearate, and mixtures thereof. Another preferred embodiment includes combinations of ethylene bis-stearamide, glycerol monostearate, stearic acid, or a quaternary ammonium compound known in the art.

Without being limited by theory, it is believed that the mixture of the invention possesses a shear thinning rheology in the temperature range between the endotherm peak temperatures of the mixture of the first and second surfactant and a Newtonian rheology at temperatures greater than the endotherm peak temperature of the upper endotherm limit of the mixture. Thus, the mixture results in a stable fabric conditioning mixture which is effectively transferred in a temperature range from about 25° C. to about 80° C. without fabric staining.

Optional Fabric Conditioning Components

If additional fabric conditioning is desired, up to about 50 wt. % of a fabric conditioning agent may be included to the mixture of surfactants and selected from the following classes of compounds:

i) Cationic quaternary ammonium salts. The counterion is methyl sulfate or any halide, methyl sulfate being preferred for the drier-added articles of the invention. Examples of cationic quaternary ammonium salts include, but are not limited to:

1. Acyclic quaternary ammonium salts having at least two $C_{8-30}$, preferably $C_{12-22}$ alkyl chains, such as: ditallow dimethyl ammonium methylsulfate, di(hydrogenated tallow)dimethyl ammonium methylsulfate, distearyldimethyl ammonium methylsulfate, dicocodimethyl ammonium methylsulfate and the like;
2. Cyclic quaternary ammonium salts of the imidazolinium type such as di(hydrogenated tallow)dimethyl imidazolinium methylsulfate, 1-ethylene-bis(2-tallow-1-methyl)imidazolinium methylsulfate and the like;
3. Diamido quaternary ammonium salts such as: methyl-bis(hydrogenated tallowamidoethyl)-2-hydroxyethyl ammonium methyl sulfate, methyl bis(tallowamidoethyl)- 2-hydroxypropyl ammonium methylsulfate and the like.

ii. Tertiary fatty amines having at least one and preferably two $C_8$ to $C_{30}$, preferably $C_{12}$ to $C_{22}$ alkyl chains. Examples include hardened tallow amine and cyclic amines such as 1-(hydrogenated tallow)amidoethyl-2-(hydrogenated tallow) imidazoline. Cyclic amines which may be employed for the compositions herein are described in U.S. Pat. No. 4,806,255 incorporated by reference herein.

iii. Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

iv. Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

v. Fatty alcohols, ethoxylated fatty alcohols, alkyl phenols, ethoxylated alkyl phenols, ethoxylated fatty amines, ethoxylated monoglycerides and ethoxylated diglycerides.

vi. Mineral oils, and polyols such as polyethylene glycol.

vii. Silicone oils as known in the art.

Tumble Drying Article

The fabric conditioning surfactant mixture of the invention is coated onto a dispensing means to form a tumble dryer article as known in the art. See Taylor et al., U.S. Pat. No. 5,254,269. Such dispensing means can be designed for single usage or for multiple uses.

A preferred article comprises the compositions of the invention affixed to a flexible substrate, such as a woven or non-woven cloth sheet. When such an article is placed in an automatic laundry dryer, the heat, the moisture, wicking mechanism due to distribution forces and tumbling action of the dryer removes the composition from the substrate and deposits it on the fabrics.

Suitable materials which can be used as a substrate in the invention herein include, among others, sponges, paper, and woven and non-woven cloth, all having the necessary absorbancy requirements as described in Taylor, U.S. Pat. No. 5,254,269 herein incorporated by reference.

In applying the fabric conditioning composition to an absorbant substrate, the composition amount impregnated into and/or coated onto the substrate is generally in the weight ratio range of from 10:1 to 0.5:1 based on the ratio of total conditioning composition to dry, untreated substrate (fiber+binder). Preferably, the amount of the conditioning composition ranges from about 5:1 to about 1:1, most preferably from about 3:1 to 1:1, by weight of the dry, untreated substrate.

Optional Additives

It is understood that optional ingredients may be included in the composition including, among others, perfumes, dyes, pigments, brighteners or fluorescent agents, colorants, germicides, bacteriocides and preservatives. The amount of each additive in the composition is up to about 0.5% by weight.

The following examples will more fully illustrate the embodiments of this invention. All parts, percentages and proportions referred to herein and in the claims are by weight unless otherwise indicated.

EXAMPLE 1

The following compositions were prepared by admixing varying amounts of N,N-di(tallowoyl-oxy-ethyl)-N,N-dimethyl ammonium methyl sulfate (HEMS) with fatty acids as follows:

TABLE 1

| Sample | HEMS[1] (% by wt. | Eutectic mixture of Fatty Acids[2] (% by wt.) | Lower Endotherm Peak Temperature (°C.) of mixture | Upper Endotherm Peak Temperature (°C.) of mixture | Melting Transition Temperature of Mixture (°C.) |
|---|---|---|---|---|---|
| 1 | 0 | 100 | 56 | — | — |
| 2 | 10 | 90 | 56 | 72 | 83 |
| 3 | 25 | 75 | 56 | 76 | 88 |
| 4 | 40 | 60 | 55 | 78 | 89 |
| 5 | 50 | 50 | 54 | 81 | 93 |
| 6 | 70 | 30 | 53 | 93 | 101 |

[1]Supplied by Hoechst Celanese of Germany.
[2]A mixture of 45 wt. % stearic acid/55 wt. % palmitic acid supplied as Emersol 132 by Emersol 132 supplied by Henkel.

Each mixture was prepared by heating the HEMS and fatty acid component to a temperature of 125° and cooling at room temperature for 15 minutes.

The upper and lower endotherm peak temperatures, as well as the melting transition temperature, of each sample were determined with a differential scanning calorimeter supplied as a DuPont 2100 device by DuPont Company of Delaware. The calorimeter was run at a scanning temperature rate of 10° C. per minute from –45° C. to 125° C. The peak temperatures were assigned at the point at which the heat flow into each sample was at its maximum.

EXAMPLE 2

The rheologies of samples 3, 5 and 6 of Example 1 were determined by a conventional method using a rheometer supplied as a Haake Rotovisco (RV 100), using an NV sample holder geometry. Shear sweeps of from 0 to 2000 $s^{-1}$ were performed at the specified temperatures.

Temperatures were maintained by means of a circulating bath which jacketed the sample holder.

The following rheology data was obtained from samples 3, 5 and 6:

TABLE 2

| Sample | Ratio of HEMS/Eutectic Mixture of Fatty Acids | Scanning Temperature | 50 s-1 | 100 s-1 | 800 s-1 |
|---|---|---|---|---|---|
| 3 | 25/75 | 65° C. | 458 mPas | 252 mPas | 83 mPas |
| | | 70° C. | 358 mPas | 236 mPas | 77 mPas |
| | | 75° C. | 133 mPas | 91 mPas | 32 mPas |
| | | 80° C. | 30 mPas | 23 mPas | 15 mPas |
| | | 85° C. | 29 mPas | 19 mPas | 9 mPas |
| 5 | 50/50 | 75° C. | 879 mPas | 467 mPas | 107 mPas |
| | | 80° C. | 141 mPas | 96 mPas | 67 mPas |
| | | 85° C. | 77 mPas | 61 mPas | 51 mPas |
| 6 | 70/30 | 90° C. | 1692 mPas | 1141 mPas | 320 mPas |
| | | 112° C. | 108 mPas | 99 mPas | 98 mPas |

It was observed that each of the 3 samples exhibited a shear thinning rheology between the peak endotherm temperatures of the mixture of the two surfactants and a Newtonian rheology at temperatures above the upper endotherm peak temperature of the mixture.

EXAMPLE 3

The following samples were prepared by admixing various amounts of HEMS with a mixture of glycerol monostearate and polyethyleneglycol monostearate:

TABLE 3

| Sample | HEMS[1] | Glycerol Monostearate (% by wt.)[2] | Polyethylene Glycol Monostearate[3] | Lower Endotherm Peak Temperature (°C.) of Mixture | Upper Endotherm Peak Temperature (°C.) of Mixture | Melting Transition Temperature of Mixture (°C.) |
|---|---|---|---|---|---|---|
| 7 | 10 | 70 | 20 | 53 | — | — |
| 8 | 25 | 65 | 10 | 55 | 69 | 72 |
| 9 | 30 | 50 | 20 | 56 | 74 | 78 |
| 10 | 30 | 60 | 10 | 59 | 73 | 80 |
| 11 | 40 | 40 | 20 | 60 | 82 | 85 |
| 12 | 45 | 45 | 10 | 61 | 82 | 85 |

[1]Supplied by Hoechst Celanese of Germany.
[2]Supplied by Unichema of England
[3]Material having an average of 4 EOs and supplied by Sherex Co.

The samples were prepared by heating the components to a temperature of 125° C. and cooling for 30 minutes at room temperature. Rheology data for Sample 8 were obtained as described in Example 2 as follows:

TABLE 4

| Sample | Temperature | 50 s-1 | 100 s-1 | 800 s-1 |
|---|---|---|---|---|
| 25 HEMS/65 GMS/10 PEG | 70° C. | 1067 mPas | 507 mPas | 163 mPas |
| | 75° C. | 70 mPas | 56 mPas | 48 mPas |
| | 80° C. | 58 mPas | 47 mPas | 39 mPas |
| | 90° C. | 48 mPas | 37 mPas | 28 mPas |
| | 100° C. | 39 mPas | 29 mPas | 20 mPas |

It was observed that the sample containing 25 wt. % HEMS exhibited shear thinning rheology between the peak endotherm temperatures of the mixture and a Newtonian rheology at temperatures above the upper endotherm peak temperatures.

EXAMPLE 5

Lower and upper endotherm peak temperatures as well as the melting transition temperatures of samples 13–21 were obtained as described in Example 1 as follows:

TABLE 5

| Sample | Cationic Material[1] | Fatty Acid[1] | Glycerol Monostearate[2] | Ethylene bis-stearamide[3] | Lower Endotherm Peak Temperature of Mixture (°C.) | Higher Endotherm Peak Temperature of Mixture (°C.) | Melting Transition Temperature of Mixture (°C.) |
|---|---|---|---|---|---|---|---|
| 13 | 52.500 | 22.500 | 25.000 | 0 | 58.8 | | 65 |
| 14 | 51.975 | 22.275 | 24.750 | 1 | 61.9 | | 67 |
| 15 | 50.925 | 21.825 | 24.250 | 3 | 58.3 | 85.0 | 90 |
| 16 | 49.875 | 21.375 | 23.750 | 5 | 61.2 | 92.3 | 98 |
| 17 | 49.350 | 21.150 | 23.500 | 6 | 59.5 | 92.2 | 103 |
| 18 | 48.825 | 20.925 | 23.250 | 7 | 59.9 | 93.1 | 103 |
| 19 | 48.300 | 20.700 | 23.000 | 8 | 59.4 | 93.5 | 102 |
| 20 | 47.775 | 20.475 | 22.750 | 9 | 60.3 | 97.5 | 104 |
| 21 | 47.250 | 20.250 | 22.500 | 10 | 61.0 | 98.9 | 105 |

[1]Mixture of di-stearyl di-methyl ammonium methyl sulfate and stearic acid supplied by Sherex as DPSC 444-35
[2]GMS supplied by Unichema
[3]Supplied as Kemamide (W-40) by Witco.

It was observed that ethylene bis-stearamide material combined with both a fatty acid and nonionic exhibited endotherm peak temperatures within the desired range. A cationic material was added to the samples to provide fabric conditioning characteristics.

EXAMPLE 6

Rheology data was obtained for sample 21 as described in Example 2 as follows:

TABLE 6

| Sample | Cationic Material | Stearic Fatty Acid | GMS | Ethylene bis-stearamide | Viscosity at 20/sec (mPas sec) | Viscosity at 800/sec (mPas sec) |
|---|---|---|---|---|---|---|
| 21 | 47.25 | 20.25 | 22.50 | 10 | 604 | 280 |

EXAMPLE 7

Tumble dryer sheet staining tests were run for several of the compositions. The test evaluated the amount of oil-like stains transferred from the dryer sheet to 100% polyester pongee cloths.

Ten pongee cloths each having 20 by 30 inch dimension were placed in a Kenmore 80 series washing machine with enough cotton bulk cloth to have a total dry load weight of three pounds. The cloths were put through a cold water rinse in a spin cycle.

A Lady Kenmore tumble dryer was preheated for 15 minutes until the dryer air temperature reached at least 115° F. Upon completion of the rinse spin cycle, the load was transferred to the preheated dryer. Dryer sheets tested were weighed and individually placed into the dryer and tumble dried with the load for thirty minutes on a cotton/sturdy cycle.

Upon completion of the dryer cycle, the dryer air temperature and sheet weight was recorded. The polyester swatches were removed from the dryer and graded for staining under northern daylight using the following rating scale:

| RATINGS | DESCRIPTION |
|---|---|
| 0 | No staining |
| 1 | Trace staining |
| 2 | Slight staining |
| 3 | Moderate staining |
| 4 | Heavy staining |

-continued

| RATINGS | DESCRIPTION |
|---|---|
| 5 | Extreme staining |

The actives on the dryer sheets which were evaluated, the original coating weight of the active, the release weight of the active and the staining score are as follows:

| SAMPLES | COATING WEIGHT (GRAMS) | RELEASE (GRAMS) | AVERAGE STAINING SCORE |
|---|---|---|---|
| Control[1] | 1.6 | 0.62 | 0.95 |
| | 2.0 | 0.90 | 2.65 |
| | 2.3 | 1.18 | 2.95 |
| 1[2] | 2.6 | 2.3 | 3.2 |
| 3[3] | 2.6 | 2.0 | 1.7 |
| 4[4] | 2.6 | 1.7 | 0.8 |
| 6[5] | 2.6 | 0.8 | 0.2 |
| 8[6] | 1.6 | 0.93 | 2.6 |
| | 1.6 | 0.74 | 2.8 |
| | 2.3 | 0.83 | 2.0 |
| 12[7] | 2.6 | 0.64 | 1.3 |

[1]70 wt. % distearyl dimethylammoniummethyl sulfate and 30% eutectic mixture of fatty acids supplied as Emersol 132 and mixed as described in Example 1.
[2]100 wt. % Emersol 132.
[3]25 wt. % HEMS and 75 wt. % Emersol 132.
[4]40 wt. % HEMS and 60 wt. % Emersol 132.
[5]70 wt. % HEMS and 30 wt. % Emersol 132.
[6]25 wt. % HEMS and 65 wt. % Glycerolmonostearate and 10 wt. % Polyethyleneglycol monostearate.
[7]45 wt. % HEMS and 45 wt. % Glycerolmonostearate and 10 wt. % Polyethyleneglycol monostearate.

The staining scores from sheets comprised of 70 wt.% of distearyl dimethylammonium methyl sulfate and 30 wt. % of eutectic fatty acids supplied as Emersol 132, are also shown as controls. The staining score of this active mixture increases dramatically with an increase of its coating weight. Sample #1, which comprised of Emersol 132 only, stained the treated fabric heavily.

Samples #3, #4 and #6, which contained mixtures of HEMS and Emersol 132 of various proportions, showed significant reduction of staining compared with the control and released more active to treated fabrics. These samples clearly demonstrated the effective transfers of their actives without staining the drying fabrics severely.

Sample #8 and #12, which are comprised of mixture of HEMS, glycerol monostearate and polyethylene glycol monostearate, also exhibited lower staining scores compare with the control of similar coating weights.

EXAMPLE 8

Two formulations were prepared by admixing HEMS with stearic acid and polyethyleneglycol monostearate in various proportions and as described in Example 1. The two formulations were coated onto a dryer sheet and tested for staining as described in Example 6 with the following results:

TABLE 8

| FORMULATION | COATING WEIGHT (GRAMS) | RELEASE (GRAMS) | AVERAGE STAINING SCORE |
|---|---|---|---|
| 45 HEMS/45 Stearic Acid/10 Polyethylene glycol Monostearate | 1.6 | 0.53 | 1.0 |
| 16 wt. % HEMS/64 wt. % stearic acid/ 20 wt. % Polyethylene glycol Monostearate | 1.6 | 0.94 | 2.0 |

TABLE 8-continued

HEMS having a high endotherm peak temperature exhibited only slight to trace staining when combined with both a fatty acid and a nonionic.

EXAMPLE 9

The following formulations were tested for staining as described in Example 6.

| SAMPLE | COATING WEIGHT (GRAMS) | RELEASE (GRAMS) | AVERAGE STAINING SCORE |
|---|---|---|---|
| Control[8] | 1.6 | 0.67 | 2.0 |
| | 2.3 | 1.1 | 2.9 |
| 21[9] | 1.6 | 0.52 | 1.4 |
| | 2.3 | 0.74 | 2.0 |

[8]DPSC 44435 supplied by Sherex is 52.5 wt. % distearyldimethylammoniummethylsulfate and 22.5 wt. % stearic acid. The DPSC was mixed with 25 wt. % glycerolmonostearate.
[9]47.25 wt. % distearyldimethylammoniummethylsulfate and 20.25 wt. % stearic acid supplied by Sherex, 22.6 wt. % glycerol monostearate and 10 wt. % ethylene bisstearamide.

It was observed that the addition of the ethylene bis-stearamide component having an upper endotherm peak temperature of 148° reduced staining over the formulation containing only the distearyl dimethyl ammonium methyl sulfate stearic acid and GMS components.

What is claimed is:

1. A tumble dryer article comprising:

(a) a mixture of at least two surfactants, (i) a first surfactant present in an amount of about 5 wt.% to about 70 wt.% and having an endotherm peak temperature of from about 75° C. to about 155° C., the first surfactant selected from the group consisting of N,N-di(tallowoyl-oxy-ethyl)-N,N-dimethyl ammonium methyl sulfate, N,N-di(tallowoyl-oxy-propyl)-N.N-dimethylammonium methyl sulfate, ethylene bis-stearamide and mixtures thereof, (ii) a second surfactant present in an amount of about 30 wt.% to about 95 wt.% and having an endotherm peak temperature of from about 35° C. to about 70° C., the second surfactant selected from the group consisting of long chain fatty acids, a glycerol derivative, a $C_8$–$C_{20}$ alkoxylated alcohol and mixtures thereof, wherein the mixture has at least two endotherm peak temperatures different from each other by at least about 1° C. up to about 40° C. as measured in a differential scanning calorimeter device and a melting transition temperature about 50° C. to about 120° C.; and (b) dispenser means for dispensing the mixture onto fabrics in a tumble dryer.

2. A tumble dryer article according to claim 1 wherein the mixture exhibits a shear thinning rheology in a temperature range between the endotherm peak temperatures of the first and second surfactants and exhibits a Newtonion rheology at a temperature above the melting temperature of the mixture.

3. A tumble dryer article according to claim 1 wherein the first surfactant is N,N-di(tallowoyl-oxy-ethyl)-N,N-dimethyl ammonium methyl sulfate.

4. A tumble dryer article according to claim 1 wherein the long chain fatty acid is selected from the group consisting of a stearic acid, a eutectic mixture of 45 wt. % stearic acid and 55 wt. % palmitic acid, and mixtures thereof.

5. A tumble dryer article according to claim 1 wherein the glycerol derivative is selected from the group consisting of methyl glucoside sesquistearate, methyl glucoside dioleate, sorbitan monostearate, sorbitan monooleate, glycerol monostearate, polyethylene glycol monostearate, and mixtures thereof.

6. A tumble dryer article according to claim 1 wherein the alkoxylated alcohol is a $C_{14}$–$C_{15}$ primary ethoxylated alcohol.

7. A tumble dryer article according to claim 1 wherein the mixture comprises from about 10 wt. % to about 40 wt. % of N,N-di(tallowoyl-oxy-ethyl)-N,N-dimethyl ammonium methyl sulfate and about 40 wt. % to about 90 wt. % of a long chain fatty acid.

8. A tumble dryer article according to claim 7 wherein the fatty acid of the mixture is a stearic acid or eutectic mixture of stearic acid and palmitic acid.

9. A tumble dryer article according to claim 1 wherein the mixture comprises from about 10 wt. % to about 40 wt. % of N,N-di(tallowoyl-oxy-ethyl)-N,N-dimethyl ammonium methyl sulfate and about 40 wt. % to about 90 wt. % of a glycerol derivative.

10. A tumble dryer article according to claim 9 wherein the glycerol derivative is glycerolmonostearate, polyethylene glycol monostearate and mixture thereof.

11. A tumble dryer article according to claim 1 wherein the first surfactant is ethylene bis-stearamide and the second surfactant is selected from the group of a long chain fatty acid, a glycerol derivative and mixtures thereof.

12. A tumble dryer article according to claim 1 further comprising a fabric softener component selected from the group consisting of a cationic quaternary ammonium salt, a tertiary fatty amine having at least one $C_8$ to $C_{30}$ alkyl chain, a carboxylic acid having 8 to 30 carbon atoms and one carboxylic group per molecule, an ester of a polyhydric alcohol, a fatty alcohol, an ethoxylated fatty alcohol, an alkyl phenol, an ethoxylated alkyl phenol, an ethoxylated fatty amine, an ethoxylated monoglyceride, an ethoxylated diglyceride, mineral oil, silicone oil and mixtures thereof.

13. A method for conditioning fabrics comprising: contacting a fabric with a tumble dryer article in a tumble dryer, the tumble dryer article comprising:

a mixture of at least two surfactants, (i) a first surfactant present in an amount of about 5 wt. % to about 70 wt. % and having an endotherm peak temperature of from about 75° C. to about 155° C., the first surfactant selected from the group consisting of N,N-di(tallowoyl-oxy-ethyl)-N,N-dimethyl ammonium methyl sulfate, N,N-di(tallowoyl-oxy-propyl)-N,N-dimethylammonium methyl sulfate, ethylene bis-stearamide and mixtures thereof, (ii) a second surfactant present in an amount of about 30 wt. % to about 95 wt. % and having an endotherm peak temperature of from about 35° C. to about 70° C., the second surfactant selected from the group consisting of long chain fatty acids, a glycerol derivative, a $C_8$–$C_{20}$ alkoxylated alcohol and mixtures thereof, wherein the peak temperatures of the first and second surfactant of the mixture are different from each other by at least about 1° C. up to about 40° C. as measured in a differential scanning calorimeter device and a melting transition temperature of the mixture being from about 50° C. to about 120° C.; and dispenser means for dispensing the mixture onto fabrics in a tumble dryer; for conditioning fabrics in a tumble dryer.

* * * * *